United States Patent [19]

Moskowitz et al.

[11] Patent Number: 4,859,124

[45] Date of Patent: Aug. 22, 1989

[54] METHOD OF CUTTING USING A TITANIUM DIBORIDE BODY

[75] Inventors: David Moskowitz, Southfield; Charles W. Phillips, Ann Arbor, both of Mich.

[73] Assignee: Ford Motor Company, Dearborn, Mich.

[21] Appl. No.: 220,126

[22] Filed: Jul. 15, 1988

Related U.S. Application Data

[62] Division of Ser. No. 124,383, Nov. 20, 1987.

[51] Int. Cl.[4] ..... B23C 1/00

[52] U.S. Cl. ..... 409/64; 407/119; 408/1 R

[58] Field of Search ..... 75/238, 244; 409/64; 407/119; 408/1 R

[56] References Cited

U.S. PATENT DOCUMENTS

| | | | |
|---|---|---|---|
| 4,145,213 | 3/1979 | Oskarsson et al. | 75/238 |
| 4,246,027 | 1/1981 | Watanabe et al. | 75/244 |
| 4,266,977 | 5/1981 | Steiger | 75/238 |
| 4,673,550 | 6/1987 | Dallaire et al. | 75/244 |
| 4,689,077 | 8/1987 | Chevigne et al. | 75/238 |

*Primary Examiner*—Stephen J. Lechert, Jr.

*Attorney, Agent, or Firm*—Joseph W. Malleck; Roger L. May

[57] ABSTRACT

Methods are disclosed of making and of using a high density high strength titanium diboride comprising material. The method of making comprises (a) compacting a mixture of titanium diboride, 5–20% by weight of a metal group binder, and up to 1% oxygen and up to 2% graphite, the mixture having a maximum particle size of 5 microns, and (b) sintering the compact to substantially full density. The $TiB_2$ may be replaced by up to 10% TiC. The method of use is as a cutting tool at relatively high speeds against aluminum based materials.

4 Claims, No Drawings

METHOD OF CUTTING USING A TITANIUM DIBORIDE BODY

This is a division of application Ser. No. 124,383, filed Nov. 20, 1987.

TECHNICAL FIELD

This invention relates to the art of making heat fused titanium boride bodies useful as cutting tools, particularly for aluminum based materials.

BACKGROUND OF THE INVENTION AND PRIOR ART STATEMENT

Considerable interest, as a potential tool material, has been aroused in the use of abrasion resistant materials which consist of or contain boron, usually in the form of a boride of titanium. The material is usually fabricated by cementing together the titanium boride material with a metallic binder which may include iron, nickel, or cobalt. However, utilizing such metal binders has not met with success because of (a) unsatisfactory strength and hardness at high temperatures, and (b) the processing temperature required for formation of the bond between the particles is too high (see U.S. Pat. No. 3,256,072).

To create a higher density sintered body with higher mechanical strength, the art has attempted to replace such metal binders with a combination of two separate components, the first of which includes a nickel phosphide or nickel phosphorus alloy, and the second consists of a metal selected from the group comprising chromium, molybdenum, rhenium, and the like, or a metal diboride, chromium diboride, or zirconium diboride (see U.S. Pat. No. 4,246,027). However, this particular replacement and chemistry has not proved entirely successful because the resulting combination of hardness and strength still remains below desired levels and still requires expensive hot pressing to achieve densification. But, more importantly, the presence of phosphorus in this prior art material can make the material unsuitable for machining aluminum based materials due to embrittlement.

SUMMARY OF THE INVENTION

The invention herein disclosed includes both a method of making and a method of using a high density, high strength titanium diboride comprising material. The method of making essentially comprises: (a) compacting a powder mixture milled to a maximum particle size of 5 microns and consisting essentially of titanium diboride, 5 -20% by weight of a metal binder with the elements thereof selected from the group consisting of cobalt, nickel and iron, up to 1.0% oxygen, and up to 2% graphite, the mixture being compacted into a body of less than required density; and (b) the compact is sintered by heating to a temperature sufficient to denslfy the compact to at least 97% of full theoretical density. Preferably, the metal binder consists of an alloy of iron and nickel with the nickel occupying 20–50% of the alloy. Alternatively, the binder may consist of an alloy comprising iron, nickel, and cobalt with nickel occupying 5–10% of the alloy and cobalt constituting 2.5–5% of the alloy.

Advantageously, the titanium diborlde may be replaced by up to 10% titanium carbide to further improve the strength and hardness combination. Graphite becomes a preferable addition, particularly up to 2% by weight of the mixture, when the oxygen content of the titanium diboride starting powder is in the range of 0.2–1.0% by weight of the mixture.

The invention further includes the method of using such titanium diboride comprising body. The method of use essentially comprises relatively moving a titanium diboride based cutting tool against an aluminum based material to machine cut said material at a relative surface speed of at least 400 surface feet per minute and depth of cut of from 0.010–250 inch, said titanium diboride based cutting tool being the heat fused product of a powder mixture of 5–20% by weight of a metal binder selected from the group consisting of cobalt, nickel and iron, and the remainder of the mixture being essentially titanium diboride except for up to 1.0% oxygen and up to 2% graphite.

The invention further resides in creation of a unique, hard, and dense sintered compact composition, the composition consisting of the heat fused product of a powder mixture of 5–20% by weight of a metal binder selected from the group consisting of cobalt, nickel, and iron, and the remainder being essentially titanium diboride except for up to 1.0% oxygen and up to 2% graphite, the particles of said powder, prior to heat fusion, having a maximum particle size equal to or less than 5 microns. The composition is characterized by a hardness equal to or greater than 90 Rockwell A, and a transverse rupture strength equal to or greater than 100,000 psi.

BEST MODE FOR CARRYING OUT THE INVENTION

It will be shown that composite materials produced from titanium diboride powder combined with either iron, nickel, cobalt, or alloys of such metals, and when prepared in a manner that the titanium diboride particle size in the final sintered product is less than 5 microns, will produce a combination of physical characteristics of hardness, strength, and density superior to titanium diboride based articles prepared by prior art techniques.

A preferred method for fabricating the material of this invention is as follows.

1. Mixing

A powder mixture of 5–20% by weight of a metal binder, the metal elements being selected from the iron group (here defined to be the group consisting of cobalt, nickel and iron), and the remainder of said mixture being essentially titanium diboride, except for up to 1.0% oxygen and up to 2% graphite. The titanium diboride powder has a purity of 99% or greater, and has typical contaminants which comprise $O_2$, $N_2$, and Fe. The metal binder powder has a purity of 99.5% or greater, and a starting particle size usually below 325 mesh. For purposes of the preferred embodiment, 90 parts by weight of a titanium diboride powder, having less than 325 mesh in particle size, was mixed with 10 parts by weight of electrolytic iron powder. Four parts by weight of Carbowax 600 (a polyethylene glycol) was stirred into the mixture to form a powder slurry.

A 200 gram batch of these constituents was ball milled under acetone for 72 hours in a stainless steel mill having a chamber approximately 12 centimeters in diameter and 12 centimeters long. Milling media in the form of 1300 grams of TiC based media, approximately 1 centimeter in diameter and 1 centimeter long, was employed. The acetone was then evaporated and the dried powder mix was screened through a 30 mesh sieve.

2. Compacting

Specimen bodies of the powder mixture were compacted at a pressure of 69–207 MPa (5–15 tons per square inch), preferably 138 MPa (10 tons per square inch), and then heated to a temperature of about 673° C. for one hour in a dry hydrogen atmosphere to dewax or remove the Carbowax 600 from the mixture.

3. Heating to Full Densification

The compacted bodies then were sintered by heating each in a furnace which was evacuated to a pressure of 0.3 microns of mercury and heated to a temperature of about 1540° C. The bodies were held at the sintering temperature for a period of about 15 minutes. Titanium carbide crystalline grains were used as the inert substrate material. The resulting sintered product possessed a hardness of 94 Rockwell A, an average transverse rupture strength of 115,000 psi, and a density over 97% of the theoretical apparent density.

It was found during experimentation with this process that the presence of a certain amount of oxygen, either as an oxide or as a elemental amount in the mixture, caused the hardness and transverse rupture strength to be less than desired. It was found that the addition of up to 2% graphite (free carbon) to the mixture, prior to milling, removed the influence of the high oxygen content and restored the physical parameters to that of specimens which did not have such oxygen content.

Iron, cobalt, and nickel, as well as their alloys, have proved to be successful binders for titanium diboride. As long as the titanium diboride grain size in the final sintered compact is maintained equal to or below 5 microns, good properties have been obtained using any of the iron group metals or their alloys as a binding agent.

EXAMPLES

Several samples were prepared according to the preferred mode wherein a specific powder mixture was prepared with titanium diboride as the base material and a metal binder in varying amounts of the selected elements. Some samples employed titanium carbide as a replacement for titanium diboride, and others contained an addition of graphite. The results from processing such mixtures according to the preferred method are illustrated in Table I, which sets forth the specific hardness, transverse rupture strength, and density for each of the specimens as processed. A hardness of no less than 90 Rockwell A and a transverse rupture strength of no less than 100,000 psi is considered satisfactory.

The latter samples 16 and 17 in Table I draw a comparison between equal mixtures of titanium diboride, titanium carbide, and nickel, one sample producing a lower hardness and strength than the other sample; the difference between the two mixtures is the oxygen content (sample 16 having 0.19% $O_2$ and sample 17 having 0.95% $O_2$). When up to 2% by weight of the composition consisted of graphite, the hardness and strength of sample 17 were restored to the level of that of a mixture having a lower level of oxygen (see sample 18). The beneficial effect of graphite additions to compositions having a higher oxygen content is important. Chemical analysis for carbon content of sintered specimens with various carbon additions up to 4% by weight indicates losses of carbon during sintering up to a maximum loss of about 2% by weight. It would appear then that the beneficial effect of carbon additions to compositions prepared is due to the reduction of oxygen that is present as an oxide or oxides in the titanium diboride powder.

Titanium diboride compacts produced in the manner described above have been found particularly suitable for use in an unobvious manner for the machining of aluminum and aluminum alloys. It has been found that titanium diboride is nonreactive in the presence of molten aluminum; and when used as a cutting tool against aluminum based materials, the titanium diboride based cutting tool exhibits a low affinity for aluminum based workpieces, provided the strength and hardness of the cutting material exceeds 100,000 psi and 90 Rockwell A, respectively. The machining test results displayed in Table II demonstrate the unobvious utility of the use of this material for machining aluminum based materials. Cutting tests were run both with and without coolants to compare the titanium diboride based cutting tool material with commercial grade C-3 tungsten carbide based cutting tools. The machining workpiece was continuously cast aluminum alloy AA 333 (8.5% silicon, 3.6% copper, and 0.4% magnesium). The workpieces were used both in the unmodified and sodium modified conditions. The tool was comprised of a material processed according to the preferred mode and having 90% $TiB_2$ and 10% Ni. The tool configuration was SPG 422. The conditions of machine cutting were 0.011 inches per revolution and depth of cut 0.060 inch. The cutting fluid was 5% soluble oil in water.

The average tool life is given in the Table in minutes; the life is measured up to a condition when the tool experiences 0.010 inch of flank wear. The average tool life for the titanium diboride based tool was 2.36 times greater than that of the commercial tungsten carbide based tool for the unmodified aluminum. A similar improvement in tool life occurred with respect to the use of the titanium diboride tool on sodium modified aluminum; the improvement in tool life was 2.52 times the life of the tungsten carbide tool. It is worth noting that, at 2000 surface feet per minute, this improvement took place when machining dry as well as when coolant was present.

Composition

The resulting material from the practice of the preferred mode is unique because it consists essentially of a titanium diboride based material consisting essentially of 5–20% by weight of an iron metal binder, said binder being selected from the group consisting of cobalt, nickel and iron, or alloys thereof, and the remainder being essentially titanium diboride except for up to 1.0% oxygen and up to 2% graphite, said material being the heat fused product of said compacted mixture and exhibiting a hardness of at least 90 Rockwell A and a transverse rupture strength of at least 100,000 psi, said heat fused product having a titanium diboride grain size equal to or less than 5 microns.

TABLE I

| Sample | $TiB_2$ | Composition (wt. %) TiC | Binder | Carbon | Hardness Rockwell A | Properties-Trans. Rupture Strength $\times 10^3$ psi Avg. | Max. | Density g/cc | % Theo. |
|---|---|---|---|---|---|---|---|---|---|
| 1 | 90 | 0 | 10 Ni | 0 | 92.8 | 104 | 143 | 4.67 | 98.2 |
| 2 | 90 | 0 | 10 Ni | 2 | 92.8 | 131 | 145 | 4.71 | 99.0 |
| 3 | 80 | 10 | 10 Ni | 0 | 93.0 | 122 | 151 | 4.74 | 99.0 |
| 4 | 85 | 10 | 5 Ni | 0 | 93.2 | 121 | 142 | 4.62 | 98.7 |
| 5 | 75 | 10 | 15 Ni | 0 | 93.0 | 111 | 125 | 4.73 | 96.1 |
| 6 | 85 | 10 | 5 Co | 0 | 93.5 | 108 | 126 | 4.57 | 97.7 |
| 7 | 85 | 0 | 15 Fe | 0 | 93.8 | 129 | 140 | 4.64 | 96.0 |
| 8 | 80 | 10 | 10 Fe | 0 | 93.0 | 148 | 164 | 4.59 | 96.4 |
| 9 | 85 | 10 | 2.5 Fe/2.5 Ni | 0 | 92.2 | 135 | 151 | 4.50 | 96.4 |
| 10 | 85 | 0 | 7.5 Fe/7.5 Ni | 0 | 91.9 | 132 | 147 | 4.54 | 93.6 |
| 11 | 80 | 10 | 6.5 Fe/3.5 Ni | 2 | 92.5 | 174 | 192 | 4.80 | 100 |
| 12 | 80 | 10 | 8.0 Fe/2.0 Ni | 2 | 91.9 | 157 | 184 | 4.68 | 98.2 |
| 13 | 90 | 0 | 8.0 Fe/2.0 Ni | 2 | 92.7 | 123 | 131 | 4.64 | 98.1 |
| 14 | 80 | 0 | 17 Fe/2.0 Ni/1.0 Co | 3 | 93.3 | 143 | 164 | 5.02 | 100 |
| 15 | 90 | 0 | 8.5 Fe/1.0 Ni/.5 Co | 3 | 94.0 | 147 | 160 | 4.86 | 100 |
| 16 | 80 | 10 | 10 Ni | 0 | 93.3 | 125 | | 4.70 | 99.8 |
| 17 | 80 | 10 | 10 Ni | 0 | 86.5 | 94 | | 4.40 | 91.6 |
| 18 | 80 | 10 | 10 Ni | 2 | 92.8 | 110 | | 4.75 | 98.9 |

TABLE II

Tool Life of $TiB_2$/Ni (90/10) Material When Machining Aluminum Workpieces

| | 1000 sfm Dry | 1000 sfm Cutting FLuid | 2000 sfm Dry | 2000 sfm Cutting FLuid |
|---|---|---|---|---|
| | (Tool Life in Minutes, 0.010 Inch Flank Wear) | | | |
| $TiB_2$ | 99 | 290 | 86 | 59 |
| C-3 WC | 91 | 72 | 34 | 29 |
| | A.A. 333 Na—Modified | | | |
| $TiB_2$ | — | 175 | 119 | 134 |
| C-3 WC | — | 90 | 43 | 37 |

We claim:

1. A method of cutting an aluminum based material with a titanium diboride based sintered material, comprising relatively moving said titanium diboride based material shaped as a cutting tool against an aluminum based material, said titanium diboride based cutting tool being the heat fused product of compacting a powder mixture of 5–20% by weight of iron metal group binder and the remainder being essentially titanium diboride except for up to 1.0% oxygen and up to 2% graphite.

2. The method as in claim 1, in which said cutting tool is moved to machine cut said aluminum based material at surface speeds of 1000–2000 sfm while experiencing reduced flank wear and increased tool life when compared to use of a cutting tool of WC of the same configuration and under the same cutting conditions.

3. The method as in claim 2, in which said aluminum based material is a sodium modified aluminum alloy.

4. The method as in claim 2, in which said machine cut is carried out dry.

* * * * *